United States Patent [19]

Sosnow

[11] Patent Number: 5,015,427

[45] Date of Patent: May 14, 1991

[54] PROCESS FOR MAKING AN ORTHOTIC FOOTWEAR INSERT

[75] Inventor: William Sosnow, Philadelphia, Pa.

[73] Assignee: Happi, Inc., Gladwyne, Pa.

[21] Appl. No.: 312,226

[22] Filed: Feb. 21, 1989

Related U.S. Application Data

[63] Continuation-in-part of Ser. No. 81,234, Aug. 4, 1987, abandoned.

[51] Int. Cl.[5] ..... B29B 7/62; B29C 35/02; B29L 31/48

[52] U.S. Cl. ..... 264/115; 264/119; 264/126; 264/320; 264/331.13; 264/349; 264/236; 36/71

[58] Field of Search ..... 264/109, 115, 123, 126, 264/331.13, 122, 48, DIG. 4, DIG. 42, DIG. 63, DIG. 77, 118, 119, 320, 319, 349, 236, 347; 425/4 C; 36/71

[56] References Cited

U.S. PATENT DOCUMENTS

| | | | |
|---|---|---|---|
| 307,059 | 10/1884 | Lynch | 36/71 |
| 545,006 | 8/1895 | Baird | 128/614 |
| 922,094 | 5/1909 | Cummings | 4/479 |
| 1,020,160 | 3/1912 | Rowe | 36/71 |
| 1,127,913 | 2/1915 | Murena | 36/37 |
| 1,128,220 | 2/1915 | Bullard | 36/37 |
| 1,315,652 | 9/1919 | Aycock | 264/109 |
| 1,613,639 | 1/1927 | Ashenhurst | 264/48 |
| 1,721,714 | 7/1929 | Ross | 36/37 |
| 2,021,467 | 11/1935 | Rosenthal | 128/588 |
| 2,112,529 | 3/1938 | Hazell | 264/48 |
| 2,119,807 | 6/1938 | Farley | 128/582 |
| 2,333,816 | 11/1943 | Pohle et al. | 264/331.13 |
| 2,379,366 | 6/1945 | Lumbard | 36/37 |
| 2,416,888 | 3/1947 | Wentworth | 264/118 |
| 2,426,735 | 9/1947 | Hiss | 128/587 |
| 2,482,333 | 9/1949 | Everston | 36/43 |
| 2,537,823 | 1/1951 | Gates | 36/95 |
| 2,598,782 | 6/1952 | Gillis | 36/129 |
| 2,737,731 | 3/1956 | Kostouros | 36/96 |
| 2,867,843 | 1/1959 | Browne et al. | 264/118 |
| 3,019,201 | 1/1962 | Clancy et al. | 264/331.13 |
| 3,258,859 | 7/1966 | Lamont | 36/127 |
| 3,265,071 | 8/1966 | Kirchner et al. | 128/586 |

(List continued on next page.)

FOREIGN PATENT DOCUMENTS

| | | | |
|---|---|---|---|
| 115427 | 8/1984 | European Pat. Off. . | |
| 1251016 | 9/1967 | Fed. Rep. of Germany | 264/123 |
| 404686 | 6/1909 | France . | |
| 56-111623 | 9/1981 | Japan | 264/126 |
| 57-111336 | 7/1982 | Japan | 264/331.13 |

*Primary Examiner*—Jeffery Thurlow
*Assistant Examiner*—Mathieu Vargot
*Attorney, Agent, or Firm*—William H. Eilberg

[57] ABSTRACT

An orthotic footwear insert is made of a resilient shock-absorbing layer. The layer has an upper surface, intended to receive the heel, the upper surface having a plurality of outwardly projecting nodules arranged in a waffle-like pattern which defines the upper plane. The layer also has a lower surface, beneath the heel-receiving surface. The lower surface has a plurality of rib members extending longitudinally between the back and front edges and generally parallel to the side edges of the layer. The rib members are therefore arranged such that air does not become trapped between them when pressure is applied to the layer. The invention also includes a method of making a shock-absorbing composition, which can be used to construct the footwear insert or other products. According to this method, an elastomeric material is comminuted into particles, and the resulting composition is formed into a desired shape. Preferably, a quantity of water is added to the composition. The material is compressed to a predetermined density, and is then heated until it is cured. The resulting composition is extremely strong and resilient, and can be formed into virtually any shape. Thus, the composition is not limited to use in footwear, but can be used in any application requiring resiliency and shock-absorbency.

11 Claims, 3 Drawing Sheets

U.S. PATENT DOCUMENTS

| | | | |
|---|---|---|---|
| 3,464,950 | 9/1969 | Wegehaupt | 523/212 |
| 3,470,880 | 10/1969 | Pagliano | 36/71 |
| 3,548,420 | 12/1970 | Spence | 623/37 |
| 3,555,706 | 1/1971 | Edmonds | 36/71 |
| 3,623,942 | 11/1971 | Yerrick | 428/101 |
| 3,696,068 | 10/1972 | Creamer | 524/264 |
| 3,865,788. | 2/1975 | Gaylord | 524/474 |
| 3,892,643 | 7/1975 | Tanaka | 522/167 |
| 3,984,926 | 10/1976 | Calderon | 36/71 |
| 4,098,858 | 7/1978 | Ten Broeck | 264/118 |
| 4,120,102 | 10/1978 | Kenigson | 36/71 |
| 4,144,658 | 3/1979 | Swan, Jr. | 36/117 |
| 4,168,585 | 9/1979 | Gleichner | 36/37 |
| 4,179,826 | 12/1979 | Davidson | 36/71 |
| 4,211,019 | 7/1980 | McCafferty | 36/43 |
| 4,255,202 | 3/1981 | Swan | 36/71 |
| 4,268,980 | 5/1981 | Gudas | 36/43 |
| 4,272,898 | 6/1981 | Tansill | 36/71 |
| 4,304,873 | 12/1981 | Klein | 162/146 |
| 4,346,525 | 8/1982 | Larsen | 36/37 |
| 4,487,906 | 12/1984 | Kniege | 528/15 |
| 4,510,636 | 4/1985 | Phillips | 12/1 R |
| 4,510,699 | 4/1985 | Nakamura | 36/43 |
| 4,520,581 | 6/1985 | Irwin | 36/71 |
| 4,521,979 | 6/1985 | Blaser | 36/29 |
| 4,530,173 | 7/1985 | Jesinsky | 36/92 |
| 4,573,279 | 3/1986 | Feurer-Zogel | 36/35 R |
| 4,611,413 | 9/1986 | Brown | 36/43 |
| 4,627,177 | 12/1986 | Meyers | 36/43 |
| 4,631,841 | 12/1986 | Hickey | 36/43 |
| 4,728,687 | 3/1988 | Watanabe et al. | 524/493 |
| 4,755,554 | 7/1988 | Itoh | 524/588 |

FIG. 2
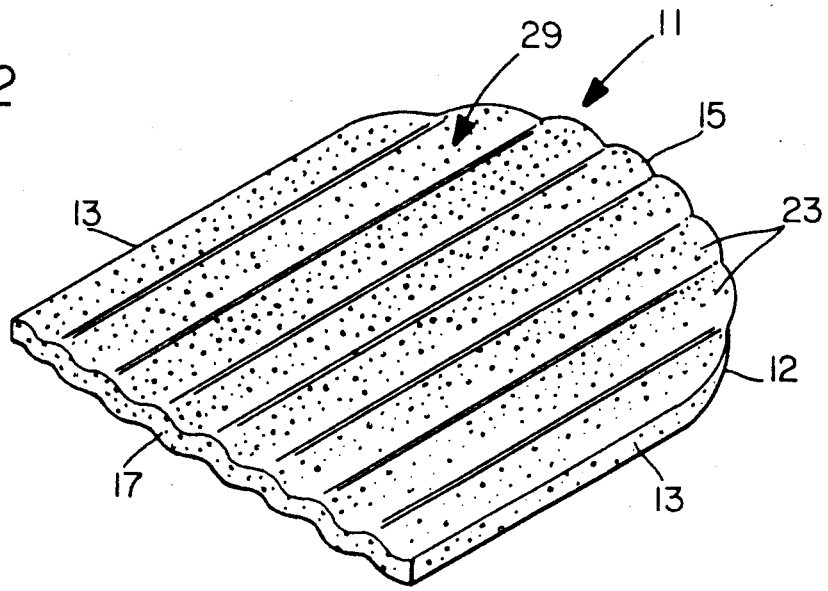
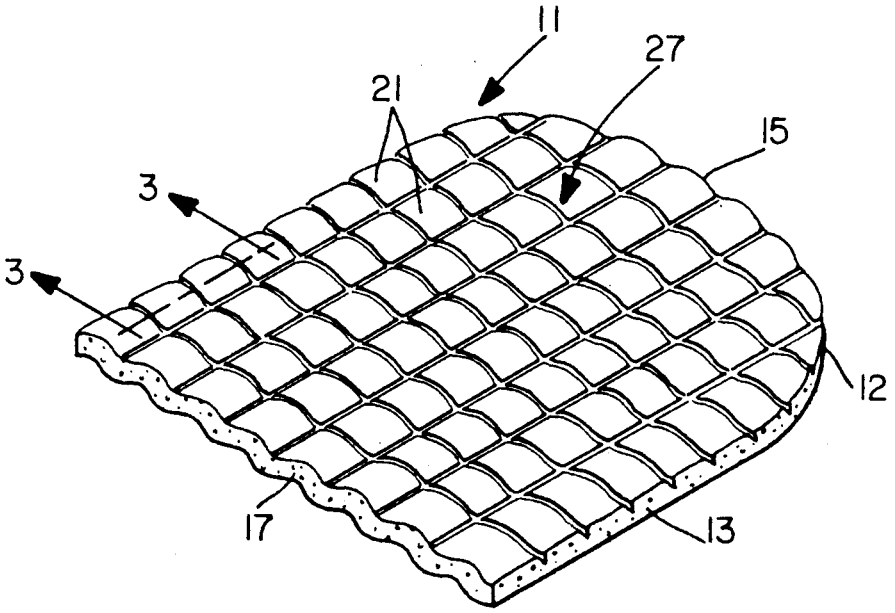
FIG. 1
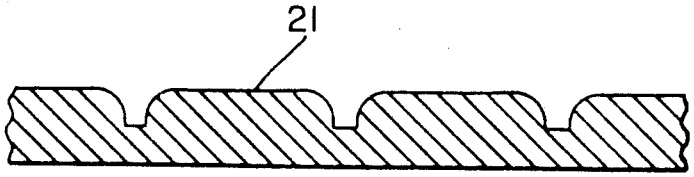
FIG. 3

FIG. 4
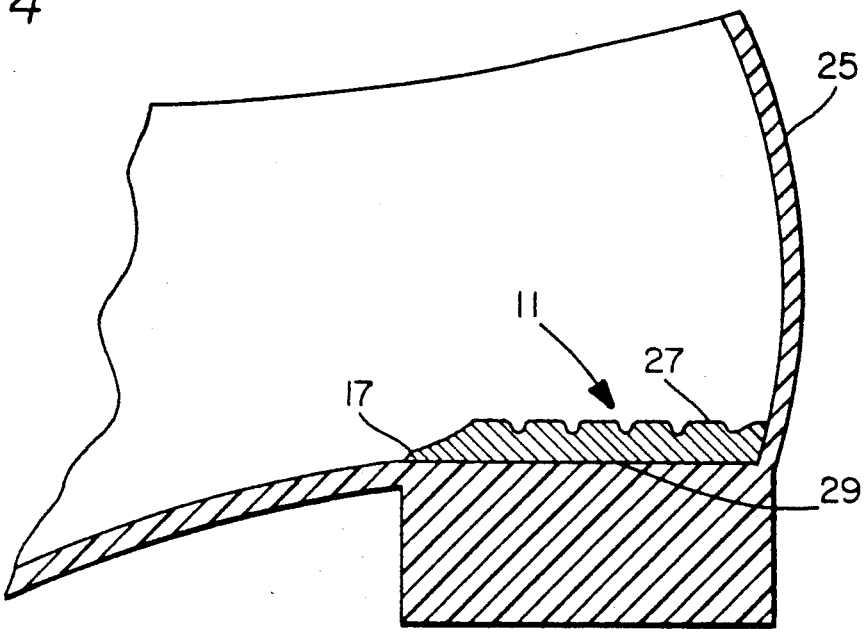
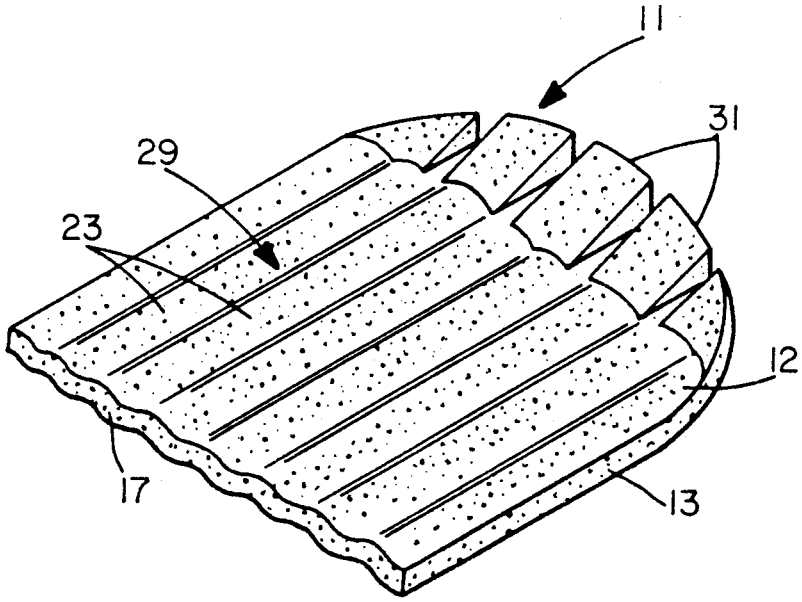
FIG. 5

FIG. 6
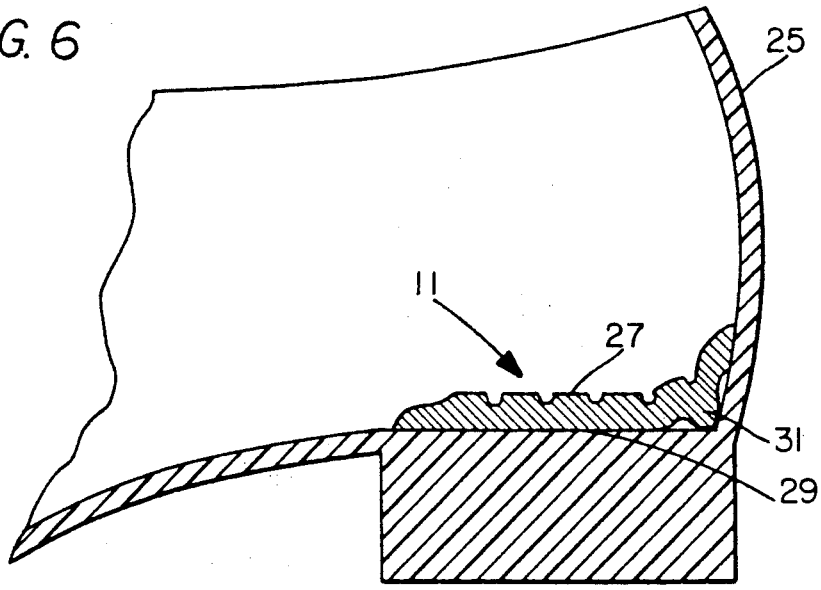
FIG. 8
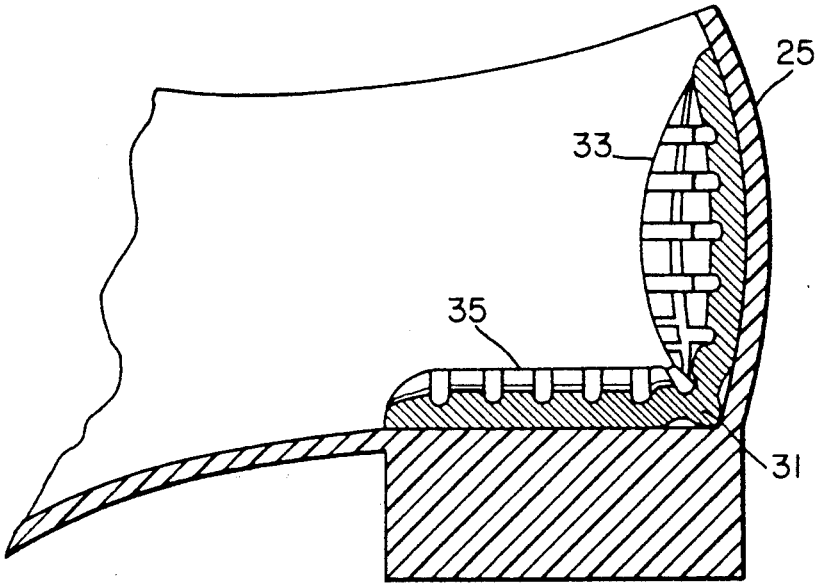
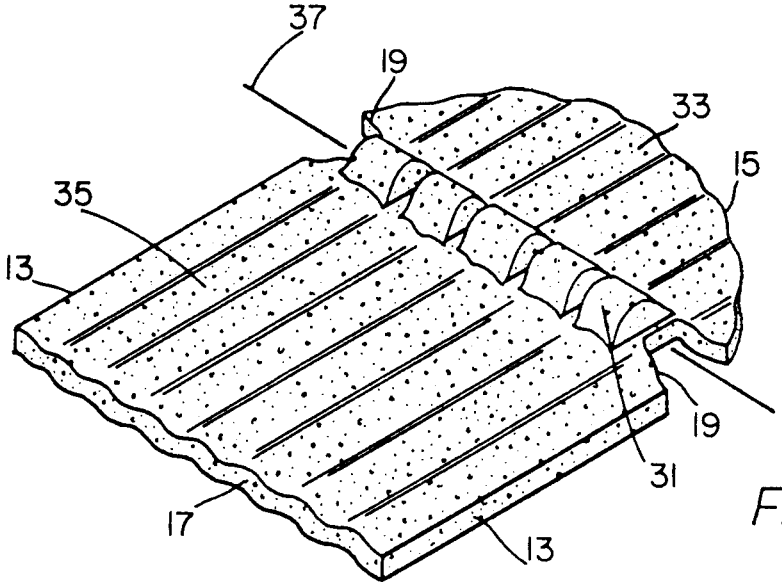
FIG. 7

PROCESS FOR MAKING AN ORTHOTIC FOOTWEAR INSERT

CROSS-REFERENCE TO PRIOR APPLICATION

This is a Continuation-In-Part of U.S. Patent Application Ser. No. 081,234, filed Aug. 4, 1987, entitled "Orthotic Footwear Insert and Process for Making Same", now abandoned.

BACKGROUND OF THE INVENTION

In the normal process of walking, the human musculo-skeletal system undergoes shock as a result of the heel striking a hard surface. Modern medical research has linked the shock wave produced by the impact of the heel on a hard surface to a number of medical problems including, among others, migraine headaches, inner ear disturbances, lower back pain, osteoarthritis, heel pain, stress fractures, and tendinitis. See, for example, E. C. Frederick, "Bone Jolt", American Health, July/August 1982, p. 64; A. Voloshin and J. Wask, "An In Vivo Study of Low Back Pain and Shock Absorption in the Human Locomotor System", J. Biomechanics, Vol. 15, No. 1, 1982, p. 21; and Eric L. Radin et al, "Role of Mechanical Factors in Pathogenesis of Primary Osteoarthritis", The Lancet, Mar. 4, 1972, p. 519. Ordinarily, the body dissipates the shock wave by a series of shock-absorbing systems. The initial shock-absorbing mechanism is a half-inch thick mat of fat and connective tissue that makes up a pad under the heel. This pad absorbs an estimated 80% of the energy passing through it. The residual shock waves are dampened by the bones of the foot and lower leg and the surrounding fleshy tissue as the waves move up the musculo-skeletal system. The above-mentioned maladies may occur when there is a breakdown in a person's natural shock-absorbing systems.

Numerous orthotic devices have been proposed to prevent or alleviate the medical problems arising from a breakdown in the body's natural shock-absorbing systems. U.S. Pat. No. 4,346,525 discloses a cushion pad fabricated from a web of closed pore foam of cross-linked ethylene 1 vinyl acetate-low density polyethylene copolymer. The pad is formed between two opposing molds to present a shape having a cup-like depression adapted and constructed to accept essentially the heel portion of the wearer. A number of sizes are required to fit the feet of possible users.

U.S. Pat. No. 4,168,585 discloses a heel cushion formed of homogeneous elastomeric material adapted to conform to the insole of a wearer's shoe to relieve the pain of a heel spur. The cushion tapers toward its forward end and has an elongated cavity in the lower surface thereof extending directly under the heel bone and a slight concavity in the upper surface located over the cavity.

U.S. Pat. No. 4,120,102 discloses an insert to fit inside a shoe below the heel of the foot. The insert is a pad of resilient material such as artificial rubber having a smooth top surface and an under surface with a plurality of ribs extending radially out from a center area under the middle of the heel. The ribs are shaped and disposed such that the pressure of the heel and the shape of the ribs tends to rotate or twist the heel around and away from the other foot.

U.S. Pat. No. 4,325,380 discloses an orthotic device having a cupshaped body member adapted to surround the heel and adjacent portions of a person's foot. The body member has three substantially solid rib members extending longitudinally along the length of the bottom of the body member. Each rib member has a width greater than its height.

U.S. Pat. No. 4,619,056 discloses an insole including a cushioning layer having a perimeter which generally conforms to the contour of the sole of the foot. On the bottom surface of the mid portion of the insole, a plurality of arcuate ridges are disposed extending across the entire width of the insole to form arcs of concentric circles having their radial centers in the middle of the heel portion of the insole.

U.S. Pat. No. 4,268,980 discloses a shock-absorbing, relatively rigid but resilient slab for insertion into footwear. The slab extends across the shoe width and lengthwise from the rear border of the heel to the metatarsal heads of the foot. The slab has a smooth top surface with a heel concavity and a varus heel ridge extending transversely from the lateral to the medial side and inclined upward to a high level at the medial side and then continuing medially to the rear end of the heel cup. The bottom has a solid lateral edge from which a plurality of longitudinally spaced ribs radiate circumferentially in a clockwise direction around the heel for an arc of about 30 degrees and then along the medial edge.

U.S. Pat. No. 4,510,699 discloses an insole of wedge-shaped, irregular or curved section fabricated from a composition of silicone rubber, inorganic filler, hydrosilicate powder and vulcanizing agent. The composition is mixed to obtain a slurry of high fluidity, poured into a mold and then heated in an oven for about an hour to harden.

One of the problems with many of the devices of the prior art is the need to provide a wide variety of sizes to fit the feet and shoes of different wearers. This creates the need for having multiple sets of molds and dies for manufacturing different sizes, which adds to the expense of producing the device for commercial sale.

Other problems arise from the materials used to make the devices. While foamed or sponge materials tend to relieve the pressure generated by the impact of the heel, they lack the resiliency needed for long-term use. For example, many foams lose their compressibility after continued use and form impressions of the foot or other high pressure areas, because of their creep properties. On the other hand, more resilient materials are often difficult to foam or are unable to be foamed and lack the compressibility needed to provide relief from painful pressure.

SUMMARY OF THE INVENTION

The present invention includes an orthotic footwear insert comprising a resilient shock-absorbing layer. In the preferred embodiment, the insert has a generally U-shaped perimeter, defining back and side edges, and terminating in a generally transverse front edge. The layer has an upper surface, intended to receive the heel, the upper surface comprising a plurality of outwardly projecting nodules arranged in a waffle-like pattern which defines the upper plane of the layer. The layer also has a lower surface beneath the heel-receiving surface. The lower surface has a plurality of rib members extending longitudinally between the back and front edges and generally parallel to the side edges. Preferably, the rib members are arranged in a regular corrugated pattern. The rib members are arranged such that there are no closed cells on the lower surface, and so that the lower surface does not form appreciable pockets of air when the insert is compressed while the user is walking.

The insert may further comprise a plurality of resilient ridge members positioned on the lower surface along the back edge thereof.

In another aspect, the invention provides an orthotic shoe insert comprising a resilient shock-absorbing layer having an upper surface and a lower surface beneath the upper surface. The perimeter of the layer is defined by a generally arcuate back edge, two generally parallel side edges, with a notch between the back edge and each side edge, and a front edge generally transverse to the side edges. The layer has a tendon-supporting portion defined by the back edge and an axis between the notches. The tendon-supporting portion is rotatable along the axis such that the upper surface of the tendon-supporting portion surrounds a portion of the Achilles tendon when worn. The layer also has a heel-supporting portion defined by the axis, the side edges, and the front edge. The heel-supporting portion has a plurality of outwardly projecting nodules arranged in a waffle-like pattern on the upper surface and a plurality of rib members extending longitudinally between the axis and front edge and generally parallel to the side edges on the lower surface. Preferably, the rib members are arranged in a regular corrugated pattern. The insert further comprises a plurality of resilient ridge members positioned on the lower surface along the axis between the notches.

The invention also includes a process for making a resilient shock-absorbing material. The process includes the steps of molding a composition which includes an elastomeric material, comminuting the material into particles, shaping the comminuted composition, applying non-vulcanizing pressure to the shaped particulate composition, sufficient to compress the composition to a predetermined density, and heating the composition with sufficient heat to cure the composition. In a preferred alternative, a quantity of water is added to the material before the comminuting step.

The invention also includes an article made according to the abovedescribed process. Preferably, the orthotic footwear inserts of this invention are made from a material molded according to the above process.

It is therefore an object of the invention to provide a footwear insert which will dissipate the shock to the musculo-skeletal system due to walking or running.

It is another object to provide an orthotic footwear insert which is extremely resilient, providing almost instantaneous recovery after impact, and which is also extremely sturdy.

It is another object to provide an orthotic footwear insert which can fit into shoes of varying sizes.

It is another object to provide a method of making a resilient, shock-absorbing material.

It is another object to provide a resilient, shock-absorbing material which can be used in a variety of applications.

It is another object to provide a resilient material which can undergo many cycles of compression and relaxation without losing its resilience.

It is another object to provide a method of making a material for use as an orthotic footwear insert.

Other objects and advantages of the invention will be apparent to those skilled in the art, from a reading of the following brief description of the drawings, the detailed description of the invention, and the appended claims.

BRIEF DESCRIPTION OF THE DRAWINGS

FIG. 1 is a perspective view of the orthotic footwear insert of this invention, showing the top surface of the insert.

FIG. 2 is a perspective view showing the bottom surface of the insert.

FIG. 3 is a cross-sectional view of the insert, taken along the line 3-3 of FIG. 2.

FIG. 4 is a cross-sectional view of the insert, of the embodiment of FIG. 1, the insert being shown within the heel area of a shoe.

FIG. 5 is a perspective view of an alternative embodiment of the invention, showing the bottom surface of the insert.

FIG. 6 is a cross-sectional view of the insert, of the embodiment shown in FIG. 5, inserted into the heel area of a shoe.

FIG. 7 is a perspective view of another alternative embodiment showing the bottom surface of the insert.

FIG. 8 is a cross-sectional view of the embodiment shown in FIG. 7, inserted into the heel area of a shoe.

DETAILED DESCRIPTION OF THE INVENTION

The present invention includes an orthotic footwear insert comprising a generally planar layer of resilient shock-absorbing material. The invention also includes a method of making a shock-absorbing material, which can be used as a footwear insert, among other things.

The basic structure of the orthotic footwear insert is shown in FIGS. 1 and 2, which illustrate the top and bottom surfaces of the insert, respectively. Insert 11 comprises a resilient shock-absorbing layer 12. Layer 12 has a generally U-shaped perimeter defining back edge 15 and side edges 13, which terminate in a generally transverse front edge 17. Preferably, the edges are tapered. Insert 11 has an upper surface 27 for receiving the wearer's heel when worn. Upper surface 27 comprises a plurality of outwardly projecting nodules 21, arranged in a waffle-like pattern, which define the upper plane. Below upper surface 27 is a lower surface 29 having a plurality of rib members 23 extending longitudinally between back edge 15 and front edge 17. Preferably, rib members 29 are arranged in a regular corrugated pattern. Preferably, the outermost portions of nodules 21 are aligned above the grooves between rib members 23.

Layer 12 is preferably formed as one piece, so that the nodules and rib members are located on opposite sides of the same structure. The thickness of the layer can vary. In the preferred embodiment, the thickness is not less than about 3/32 inches, and no more than about ½ inches. These thicknesses are peak-to-peak dimensions, i.e. measured from the tops of the nodules to the tops of the rib members.

Insert 11 may further comprise a plurality of ridge members 31, shown in FIG. 5, positioned on lower surface 29 along back edge 15. Ridge members 31 may be fabricated from the same resilient shock-absorbing material as layer 12 and may be integrally molded or adhesively attached thereto. Preferably, ridge members 31 have a generally triangular cross-section.

In another embodiment, shown in FIG. 7, the insert comprises a resilient shock-absorbing layer having an upper surface and a lower surface, as before. The perimeter of the insert is defined by a generally arcuate back edge 15 and two generally parallel side edges 13. The insert includes a notch 19 between back edge 15 and each side edge 13, and a front edge 17 generally transverse to side edges 13. Insert 11 has a tendon-supporting portion 33 and a heel-supporting portion 35.

Heel-supporting portion 35 is defined by front edge 17, side edges 13 and an axis 37 between notches 19. The upper surface of heel-supporting portion 35 may comprise a plurality of outwardly-projecting nodules arranged in a waffle-like pattern, similar to that of FIG. 1. The lower surface of heel-supporting portion 35 may further comprise a plurality of rib members, similar to those of FIG. 2, extending longitudinally between axis 37 and front edge 17, generally parallel to side edges 13, and preferably arranged in a regular corrugated pattern. Tendon-supporting portion 33 is defined by back edge 15 and axis 37.

The embodiment of FIG. 7 also comprises a plurality of resilient shock-absorbing ridge members 31 positioned along axis 37 on the lower surface of the insert. When worn, the insert is rotated about axis 37 such that the insert forms a cup-like cavity for receiving the rear portion of the wearer's foot, as shown in FIG. 8. The upper surface of the heel-receiving portion 35 is disposed adjacent to and supports the heel of the wearer's foot. Tendon-supporting portion 33 surrounds and supports the lower portion of the wearer's Achilles tendon.

An important feature of the present invention is that the lower side of the shock absorbing layer does not define air pockets to achieve the cushioning effect. On the contrary, because the rib members 23 extend in only one direction, e.g. in the longitudinal direction, as shown in FIG. 2, air is not trapped by these ribs when pressure is applied while the insert is worn. When the wearer presses down on the resilient layer, the cushioning effect results from the elastic deformation of the material itself, not from a pocket of air. Whatever air is present between the ribs is substantially expelled, because the air is free to travel along the grooves between the ribs. The present invention therefore contrasts with many of the cushions of the prior art which have both longitudinal and transverse ribs on the lower surface of a resilient layer. In such prior art constructions, the longitudinal and transverse ribs together define cells which trap air within them, to provide a cushioning effect. It has been found that the resilient material of the present invention provides much better cushioning than is obtainable with air pockets.

It is not absolutely necessary that the ribs on the lower surface be oriented in the longitudinal direction. What is important is that substantially all of the ribs be generally parallel to each other, so as not to create air pockets. Thus, it is possible for the ribs to be transverse or diagonal. The latter arrangements would still prevent the formation of air pockets when pressure is applied to the resilient layer. The longitudinal arrangement is preferred, however, because the ligaments of the foot are themselves longitudinal, and this arrangement is believed to give the best support for the foot.

A major advantage of the insert of this invention is that an insert of one size may be used for a number of different size shoes and feet. The generally planar, flexible layer 12 may be inserted in a shoe such that a portion of the layer near the side edges 13 and back edges 15 are disposed against the side walls of the shoe. Another advantage is that the outwardly-projecting nodules 21 on the upper surface 27 tend to massage the wearer's heel as the person walks. This may improve blood circulation in the heel area of the wearer's foot. The grooves between the rib members 23 and nodules 21 also promote ventilation of the wearer's foot. Furthermore, when the insert is fabricated from a resilient material such as those described below, the insert absorbs shock normally experienced during walking. This absorption of shock may alleviate or prevent problems of osteoarthritis, heel pain, stress fractures and tendinitis.

The insert according to the invention is molded from an elastomeric polymer. Polymers such as silicone rubber, synthetic rubbers, polyurethanes, or polyethylene may be used. These polymers may be mixed with various kinds of fillers, foaming agents and other additives. The insert may be molded using conventional methods such as compression molding or injection molding. However, the materials and methods described below are preferred.

The preferred resilient material of this invention is a vinyl silicone rubber compound. The composition may include a vinyl silicone rubber, fumed silica filler, and a vulcanizing agent. Other fillers can be added. Compositions of this type are generally available, and a typical example is the composition sold under the trademark "Laur CF-1-6-87", available from Laur Silicone Rubber Compounding, Inc. of Beaverton, Michigan. The latter material is believed to include mainly a vinyl silicone rubber, a fumed silica filler, and a vulcanizing agent. In their unvulcanized state, these compounds are tacky, malleable, clay-like substances. They are generally molded and vulcanized using known high pressure, high temperature techniques. However, in accordance with the present invention, a method has been developed which produces a resilient material having a sponge-like structure without using blowing or foaming agents and high pressure. Also, the use of plasticizers is not necessary.

The invention is not limited to the specific elastomer mentioned above. It is believed that virtually any elastomer could be used, such as polyurethane, polyvinylacetate, polyvinylchloride, other silicone formulations, or any resin that can be formed into an elastomer. Any substance in the family of elastomers that is tacky, and can be comminuted, and which is naturally self-adherent, could be used in making the product of the present invention. One could also use a visco-elastic gel, which is also commercially available.

In one embodiment of the process of this invention, the above-described composition is first comminuted into particles. The particles may be regular or irregular, generally spherical or elongated. The comminuted composition is then shaped and compressed with a non-vulcanizing pressure to achieve a predetermined desired density and form. Pressure in the range of about 5 psi to about 100 psi is preferred. The shaped composition is subsequently heated with sufficient heat to vulcanize the composition. Virtually any heated-air oven can be used, such as ovens fueled by gas or electricity. A microwave oven, however, will not work, as its heat will not cure silicones.

In an alternative embodiment of the process of the invention, a quantity of water is added to the above-described composition before it is comminuted. The exact amount of water added is not critical, but it should be in sufficient quantity that there will be an excess of water to drain off later. It has been found that the amount of water used should be of the order of about two tablespoons per ounce of elastomer. Stated another way, the preferred amount of water should have a weight which is approximately equal to the weight of the elastomer.

As mentioned above, excess water is allowed to drain off before pressure is applied to the comminuted composition. Then, as one shapes the composition under pressure, additional excess water is likely to appear, and this water is also drained off. Thus, excess water is drained both before and after the comminuting step. The remaining process steps are as described above.

The water is believed to act as a blowing agent when the composition is heated. However, it has been observed that the overall size of the final composition is not increased when water is used. The composition made with the water has been found to be much more resilient than the composition made without the water, although the tensile strength of the product is somewhat greater when water is not used. The tensile strength of the product made with water is about 100 pounds.

The excellent results obtained by mixing water with the elastomeric material are particularly surprising because water has long been considered undesirable in plastics and rubber molding. It is standard practice in the rubber molding industry to dry a composition, before molding, to avoid the formation of blemishes in the final product. But in the present invention, the product made with water is much more elastic, and therefore much more useful as a shock-absorbing layer, than the same composition prepared without water.

It has been found that articles produced according to both embodiments of this process are resilient yet have excellent compressibility. Furthermore, the tensile strength of the material, made according to either embodiment, is much higher than similar sponge-like or foamed materials. The composition made according to the invention recovers almost instantaneously after release of pressure, and continues to exhibit virtually the same degree of resilience after many cycles of compression and relaxation. The material distorts both horizontally and vertically, and springs back immediately when the pressure is removed. The composition is thus ideally suited to many applications requiring rapid dissipation of shock forces.

The composition made according to the invention has a comparatively rough surface. This feature is especially apparent when the composition is made with water, as described above. The rough surface increases friction. Thus, when the composition is used as a footwear insert, it tends to reduce slippage of the foot, and thereby reduces the likelihood of formation of calluses.

Another advantage of the composition of the present invention is its ability to conduct water vapor. Water vapor is known to pass readily through silicones. This property enhances the comfort of the composition when used as a footwear insert.

The following Example shows the manufacture of a molded composition according to the present invention.

EXAMPLE

About 1.25 ounces of bulk elastomer stock, of the type known as Laur CF-1-6-87, described above, were weighed out. The quantity of elastomer stock was cut into small pieces, having approximately cubic shapes with a side dimension of about 0.25 inches. The elastomer was placed in the bowl of a food blender. An Oster food blender, having a maximum power of 390 watts, was used. Two tablespoons of clean, cold spring water were added to the bowl. This quantity is great enough to create a surplus of water, which will later need to be drained.

The composition was comminuted in the blender by operating the blender at its highest speed for approximately 60 seconds. Most of the comminuted particles ranged in size from about 1/64 inches to about 1/100 inches in their average diameter. The latter range is only an estimate, and some of the particles are believed to have had a diameter of as much as about 1/16 inches. The particles adhere to each other because of their innate tackiness. Excess water was allowed to drain off.

A sheet of plastic wrap, about 12 inches by 12 inches, was used as a mold release agent, and a portion of this sheet was placed over a mold which had the shape of the desired final product. The comminuted elastomer was then carefully transferred to the mold, and was leveled in the mold, so as to have a substantially uniform depth of about 0.375 inches. In this Example, the mold had the shape of the corrugations shown in FIG. 2, as the final product was to be used to make the footwear insert of the present invention. The composition was then covered with the remaining portion of the plastic sheet, folded over the first portion. Two distinct sheets of plastic wrap could also have been used.

A pattern similar to that shown in FIG. 1 was then impressed onto the composition by rolling the composition with a cylinder having external, generally straight-line corrugations. The cylinder was applied in both of two mutually-perpendicular directions, so as to create the pattern shown in FIG. 1. The cylinder was applied by hand, with a total pressure of about 50–70 pounds, or about 10 pounds per square inch, or less, of contact pressure.

The uncured product was stripped from the plastic wrap by lifting the product up from the mold and gently pulling away the plastic wrap. The product is reasonably strong even without curing, and does not deform during stripping or handling.

The uncured product was then placed in an oven, heated to approximately 500° F., for five minutes. The oven can be a conventional domestic gas oven, or a toaster-oven, or equivalent device. The product was removed from the oven, and was allowed to cool in the open atmosphere.

While the invention has been described with respect to specific embodiments, it is apparent that many modifications can be made. The elastomer used to make the resilient shock-absorbing layer can be varied. The resilient composition of the invention may be used in many applications, and is not limited to use in footwear. The particular shape of the footwear insert is also not critical, and can be varied to suit particular needs.

The structure of the waffle-like pattern formed on the upper surface of the footwear insert can also be varied. In the embodiment shown in FIG. 1, the waffle-like pattern is defined by lines which are mutually perpendicular, so that the nodules are formed as squares. One could also employ lines which are not mutually perpendicular, so that the nodules are not square but diamond-shaped. The nodules could also be formed as triangles, or even circles. These variations are essentially equivalent to the square nodules, and are intended to be alternatives to the embodiment described above. In some cases, the diamond-shaped nodules may be less expensive to produce than the square nodules.

All of the above-described variations should be considered within the spirit and scope of the following claims.

What is claimed is:

1. A process for making a resilient, shock-absorbing, shaped product, comprising the steps of:

(a) comminuting a self-adherent, clay-like, bulk elastomeric material into particles, wherein the particles retain their self-adherence after comminution and are capable of being formed into the shaped product, (b) shaping said comminuted material into the shaped product, (c) applying non-vulcanizing pressure to said shaped comminuted material, the pressure being sufficient to compress said material to a predetermined density, wherein the material is formed into the shaped product, and (d) heating said shaped product with sufficient heat to cure the material.

2. The process of claim 1, wherein the comminuting step is preceded by the step of adding water to the elastomeric material.

3. The process of claim 2, wherein the water is added in an amount sufficient to produce an excess of water to be drained off after the pressure-applying step.

4. The process of claim 1, wherein the elastomeric material comprises a mixture including vinyl silicone rubber, fumed silica filler, and vulcanizing agent.

5. A process for making a resilient, shock-absorbing shaped product, comprising the steps of:

(a) adding water to a bulk, self-adherent elastomeric material, (b) comminuting said elastomeric material into particles after the water has been added, (c) shaping said comminuted material into the shaped product, (d) applying non-vulcanizing pressure to said shaped comminuted material, the pressure being sufficient to compress said material to a predetermined density, and (e) heating said shaped product with sufficient heat to cure the material.

6. The process of claim 5, wherein the comminuting step is followed by the step of draining excess water from the material.

7. A process for making a resilient, shock-absorbing, shaped product, comprising the steps of:

(a) comminuting a self-adherent, clay-like, bulk elastomeric material into particles, wherein the particles retain their self-adherence after comminution and are capable of being formed into the shaped product, (b) shaping said comminuted material, into the shaped product, (c) applying non-vulcanizing pressure to said shaped comminuted material, the pressure being sufficient to compress said material to a predetermined density, wherein the material is formed into the shaped product, the pressure-applying step being performed without fully enclosing said material, and (d) hating said shaped product with sufficient heat to cure the material.

8. The process of claim 7, wherein the pressure-applying step comprises the step of rolling a cylinder over the material.

9. A process for making a resilient, shock-absorbing shaped product, comprising the steps of:

(a) adding a quantity of water to a self-adherent, clay-like, bulk elastomeric material, (b) comminuting said bulk elastomeric material into particles after the water has been added, (c) shaping said comminuted material into the shaped product, (d) applying non-vulcanizing pressure to said shaped comminuted material, the pressure being sufficient to compress said material to a predetermined density, and (d) heating said shaped product with sufficient heat to cure the material.

10. The process of claim 9, wherein the pressure-applying step is performed without fully enclosing said material.

11. The process of claim 9, wherein the pressure-applying step comprises the step of rolling a cylinder over the material.

* * * * *